US005118034A

United States Patent [19]

Tsao

[11] Patent Number: 5,118,034

[45] Date of Patent: Jun. 2, 1992

[54] FOOD-ACCOMMODATING CONTAINER HAVING MULTI-FUNCTIONAL FLAPS

[76] Inventor: Chung-Piao Tsao, 12 Fl., No. 425-1, Jen Ai Rd., Sec. 4 Taipei, Taiwan

[21] Appl. No.: 751,657

[22] Filed: Aug. 22, 1991

Related U.S. Application Data

[63] Continuation-in-part of Ser. No. 660,803, Feb. 26, 1991, abandoned.

[51] Int. Cl.[5] ..... B65D 5/10

[52] U.S. Cl. ..... 229/117.14; 229/114; 229/155; 229/186

[58] Field of Search ..... 229/114, 155, 188, 117.13, 229/117.14, 1.5 B, 186; D7/608

[56] References Cited

U.S. PATENT DOCUMENTS

| | | | |
|---|---|---|---|
| 1,607,865 | 11/1926 | Butler | 206/542 |
| 1,687,678 | 10/1928 | Mallory | 229/1.5 C |
| 1,941,514 | 3/1932 | Sutherland | 229/114 |
| 1,985,111 | 12/1934 | Shofer et al. | 229/188 |
| 2,056,032 | 9/1936 | Berman | 229/155 |
| 2,336,655 | 12/1943 | Tobey et al. | 229/155 |
| 2,341,762 | 2/1944 | Conklin | 229/117.14 |
| 2,355,729 | 8/1944 | Inman | 229/155 |
| 2,355,730 | 8/1944 | Inman | 229/155 |
| 2,398,200 | 4/1946 | Van Voorhis | 229/155 |
| 2,433,926 | 1/1948 | Sayre | 229/1.5 C |
| 2,522,950 | 9/1950 | Keith | 229/117.14 |
| 2,596,087 | 5/1952 | Shoudy | 229/155 |
| 2,661,142 | 12/1953 | Hendrickson, Jr. | 229/117.14 |
| 2,682,988 | 7/1954 | Van Rosen et al. | 229/188 |
| 3,104,795 | 9/1963 | Adams | 229/155 |
| 3,164,290 | 1/1965 | Paredes | 229/117.13 |
| 3,591,070 | 7/1971 | Vrana | 229/155 |
| 3,679,093 | 6/1972 | Chang | 229/103.1 |
| 3,722,779 | 3/1973 | Chang | 229/1.5 C |
| 4,063,678 | 12/1977 | Hall | 229/155 |
| 4,498,585 | 2/1985 | Gordon et al. | 229/103.1 |
| 4,520,930 | 6/1985 | Lisiecki | 229/103.1 |
| 4,811,846 | 3/1989 | Bottega | 229/125.03 |

FOREIGN PATENT DOCUMENTS

| | | | |
|---|---|---|---|
| 0115386 | 11/1945 | Sweden | 229/117.14 |
| 0366488 | 2/1963 | Switzerland | 229/155 |
| 0480138 | 2/1932 | United Kingdom | 229/117.14 |

*Primary Examiner*—Stephen Marcus
*Assistant Examiner*—Christopher McDonald

[57] ABSTRACT

A container for accommodating foods comprising multifunctional inner and outer flaps. The pair of inner flaps are interconnectable with each other to close an opening of the container body and are disposed with various slits for receiving and supporting a spoon, fork, straw, or the like thereon. The pair of inner flaps are anchorable to side walls of the container body to allow easy access of the contents within the container body. The pair of outer flaps which have punch-out flaps thereon, are engageable with each other to permit a clasping operation by a user's hand, with the punch-out flaps and end portions of the outer flaps forming a triangular space for receiving chopsticks. The outer flaps are also interconnectable with each other to close the opening of the container body for easy transport and storage.

1 Claim, 16 Drawing Sheets

FOOD-ACCOMMODATING CONTAINER HAVING MULTI-FUNCTIONAL FLAPS

CROSS-REFERENCE TO RELATED APPLICATION

The present application is a continuation-in-part of U.S. application Ser. No. 07/660,803, filed Feb. 26, 1991, now abandoned, the entire contents of which are hereby incorporated herein by reference.

BACKGROUND OF THE INVENTION

The present invention relates generally to containers having a container body for accommodating foods and two pairs of cover flaps for closing an opening of the container body. More particularly, the present invention relates to multifunctional flaps on the containers in which a pair of inner flaps are interconnectable with each other to receive a spoon, a fork, a straw, napkins, or the like, or are anchorable to side walls of the container body, and in which a pair of outer flaps are either engageable with each other to receive chopsticks and permit clasping by a user's fingers, or interconnectable with each other to close the opening of the container body.

Containers, such as carry-out containers, take-away containers, doggy bags, etc. for accommodating foods are common and generally comprise a container body and a pair of inner flaps and a pair of outer flaps both integrally formed on a corresponding peripheral edges of the body. In addition, a wire handle of metallic material, generally provided on the container body and fastened across a pair of side walls thereof, may be required in order that the container can be carried by human hands. The provision of the wire handle on the container body, as known in this art, is somewhat complicated, involving the operation of providing hook-holes on the side walls of the body and then fastening two ends of the wire handle to the hook-holes. While this prior art container works well to a certain extent, there are still disadvantages and limitations associated with the provision of the wire handle remaining to be improved.

For example, in the above prior art container, the wire handle fastened to the container body for easy grasping will have to be removed before the container is disposed in a micro-wave. This is inconvenient and might accidentally spoil the contents of the container, or even result in the danger of hurting oneself. Also, in the case that the container body is tilted, when holding the wire handle, due to a misaligned or deflected position of the hook-holes on the walls of the body, the contents, e.g., soup, is liable to flow out. Further, since the positions of the hook-holes cannot be seen from inside of the container body, it is not uncommon that soup might leak from these hook-holes if the soup within the body occupies a level above that of the hook-holes. The hook-holes therefore further undesirably confine a quantity of soup that the container body can accommodate to be below a certain level. Since the wire handle is made of metal, e.g., iron, it will gradually become rusted, during storage before or after use, due to moisture when exposed under atmosphere.

Accordingly, there is a need to do without the metal wire handle on containers, while still retaining its intended purpose for easy take and carry. It is found that the flaps of the containers can serve to achieve this instead of the introduction of a separate metal wire handle. By reconfiguring the inner and outer flaps to have an engaging means and a hand-accessible means integrally formed thereon, respectively, the use of a wire handle is obviated and associated problems with the wire handle in prior art are removed.

In providing a container having novel flaps which prevent the above-mentioned disadvantages, it is further found that many advantages not available by the use of a wire handle, or even unknown in prior art, can be obtained by reconfiguration or design of the inner and outer flaps. For example, since the hand-accessible means is integrally formed on the outer flaps, the load consisting of the container body and its contents will be evenly supported due to the line contact between the outer flaps and corresponding peripheral edges of the container body. The hand-accessible means, when interconnecting the outer flaps with each other, preferably forms a flat bottom surface so that user's fingers can suitably carry the container from below the bottom surface. Also, the engaging means, which can interconnect the inner flaps with each other (thereby closing an opening of the container body), is engageable with a pair of the side walls of the body so that the inner flaps are anchorable to the body, thereby providing easy access to the contents thereof. On the inner flaps, and optionally on the outer flaps, slits of various shapes may be provided to receive, cooperatively or directly, a fork, spoon, straw, utensil, napkin, chopsticks, etc., so that they can be provided together with the container.

SUMMARY OF THE INVENTION

Accordingly, it is an object of this invention to provide a container for accommodating foods which can be directly put inside a refrigerator or a micro-wave oven.

A futher object of this invention is to provide a container having multifunctional flaps which comprise engaging means and hand-accessible means for receiving a fork, spoon, straw, utensil, napkin, chopsticks, etc.

Another object of this invention is to provide a container having multifunctional outer flaps which comprise hand-accessible means integrally formed thereon for easy grasping by user's hands. The hand accessible means also evenly supports the load consisting of the container body and its contents due to a line contact between the outer flaps and corresponding peripheral edges of the container body.

Yet a further object of this invention is to provide a container which does not have any hook-holes on the side walls of the container body so that the container can accommodate liquid foods without the possibility of leakage.

Yet another object of this invention is to provide a container having multi-function inner flaps which comprise engaging means integrally formed thereon. The engaging means, which can interconnect the inner flaps with each other (thereby closing an opening of the container body), is further engageable with a pair of the side walls of the body so that the inner flaps are anchorable to the body, thereby providing easy access to the contents of the body.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
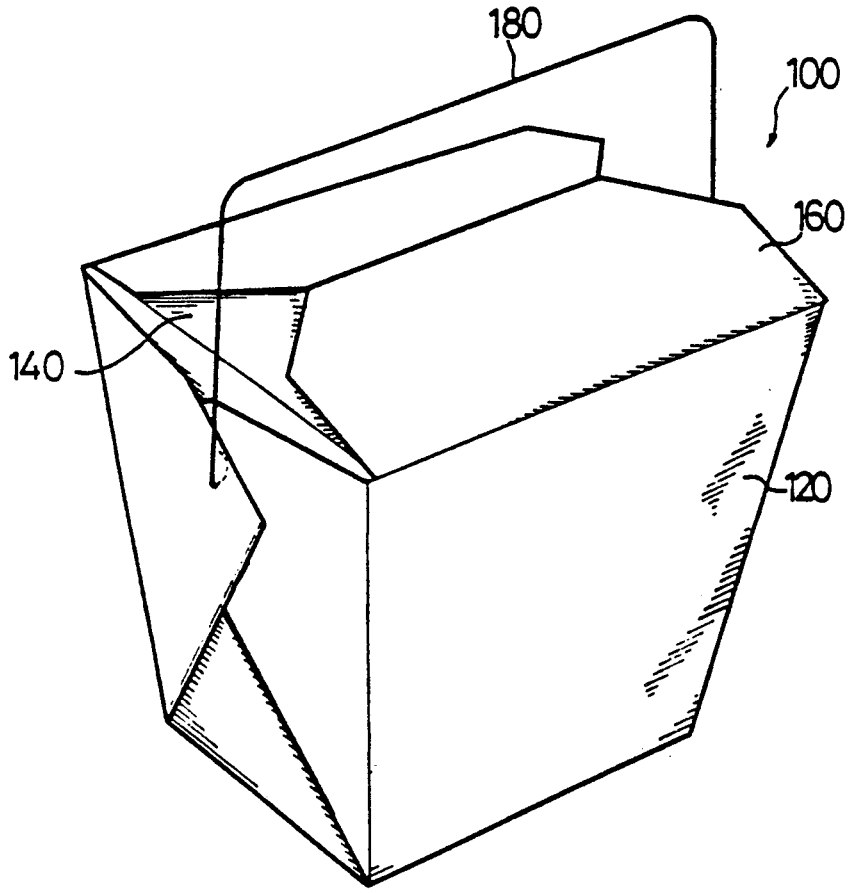
FIG. 1 PRIOR ART
FIG. 1 is a perspective view showing a container for accommodating foods according to prior art.
Figure 2:
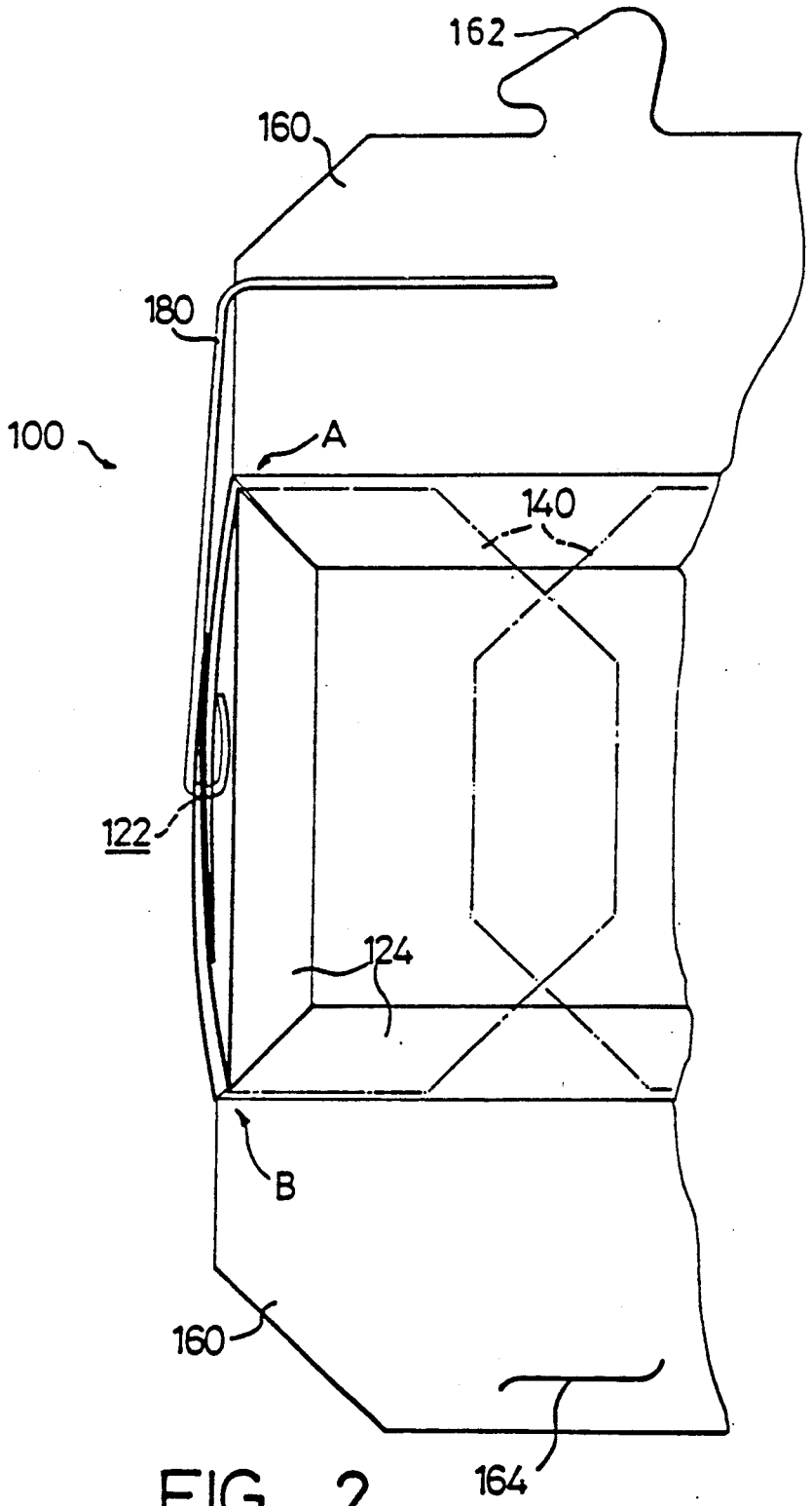
FIG. 2 PRIOR ART
FIG. 2 is a top plan view of the container of FIG. 1 with a pair of outer flaps being opened to show a pair of inner flaps.

Referring firstly to FIGS. 1 and 2, there is shown a prior art container 100 which generally comprises a body portion 120, a pair of inner flaps 140 (shown in phantom line in FIG. 2), a pair of outer flaps 160, and a wire handle 180. As is known, the body portion 120 and inner and outer flaps 140 and 160 are integrally formed of a pressboard which can be subjected to a temperature range from −10° C. to 160° C. and is readily applicable to a refrigerator or a microwave oven, while the separately provided wire handle 180 is made of a metal, which should be removed from the container 100 before being subjected to a microwave. FIG. 2 clearly shows the shapes of the inner flaps 140 and the outer flaps 160, as well as hook-holes 122 on side walls of the body portion 120. The pair of inner flaps 140 are so configured that they simply and substantially cover an opening of the container body 120. On the contrary, the pair of outer flaps 160 are interconnectable with each other by providing a finger portion 162 on one of the flaps 160 and a slit 164 on the other flap 160. It can be seen that there are not any holes on inner walls 124 of the container body 120, except for the above hook-holes 122. However, it is noted that fluids, e.g., soup, within the container body still may leak from corner portions, as indicated by arrows A and B in FIG. 2 and finally through the hook-holes 122.

Figure 3:
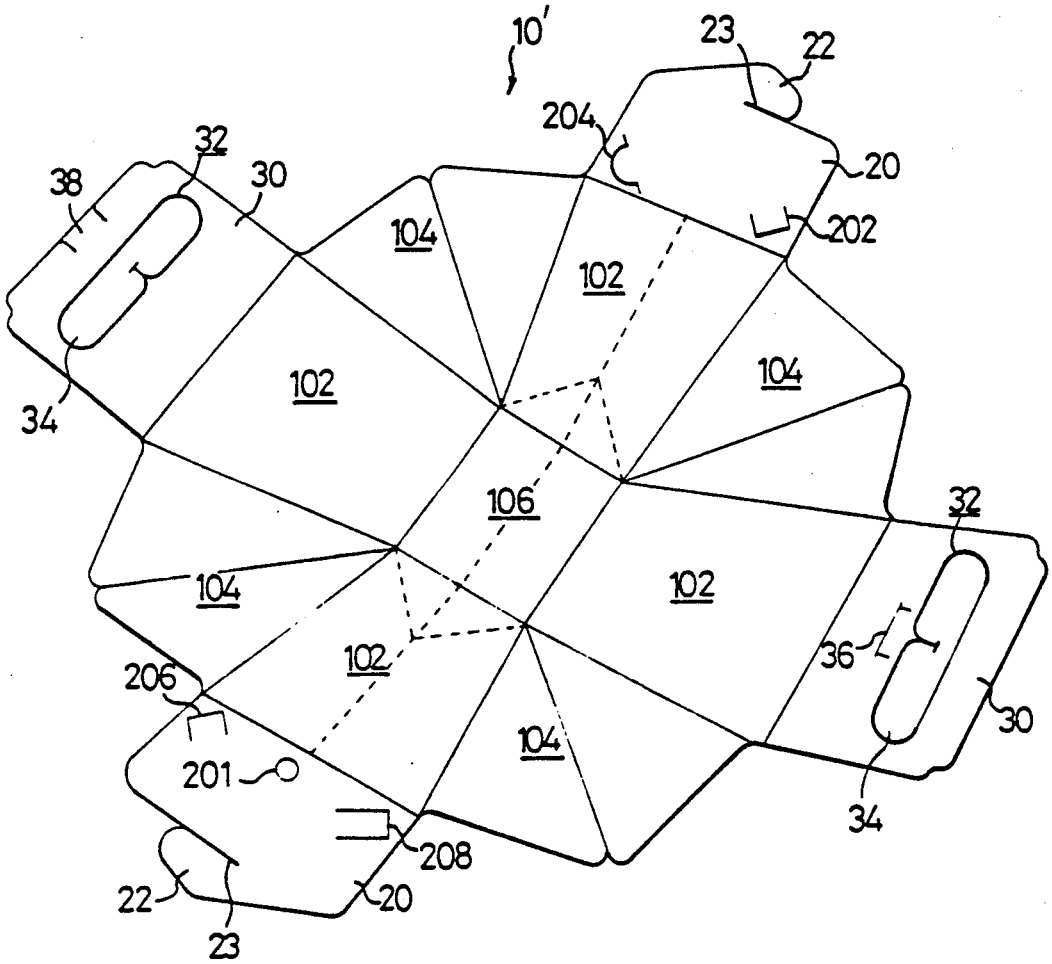
FIG. 3 is an unfolded top plan view of a pressboard suitable for constructing a container in accordance with the present invention.
Figure 4:
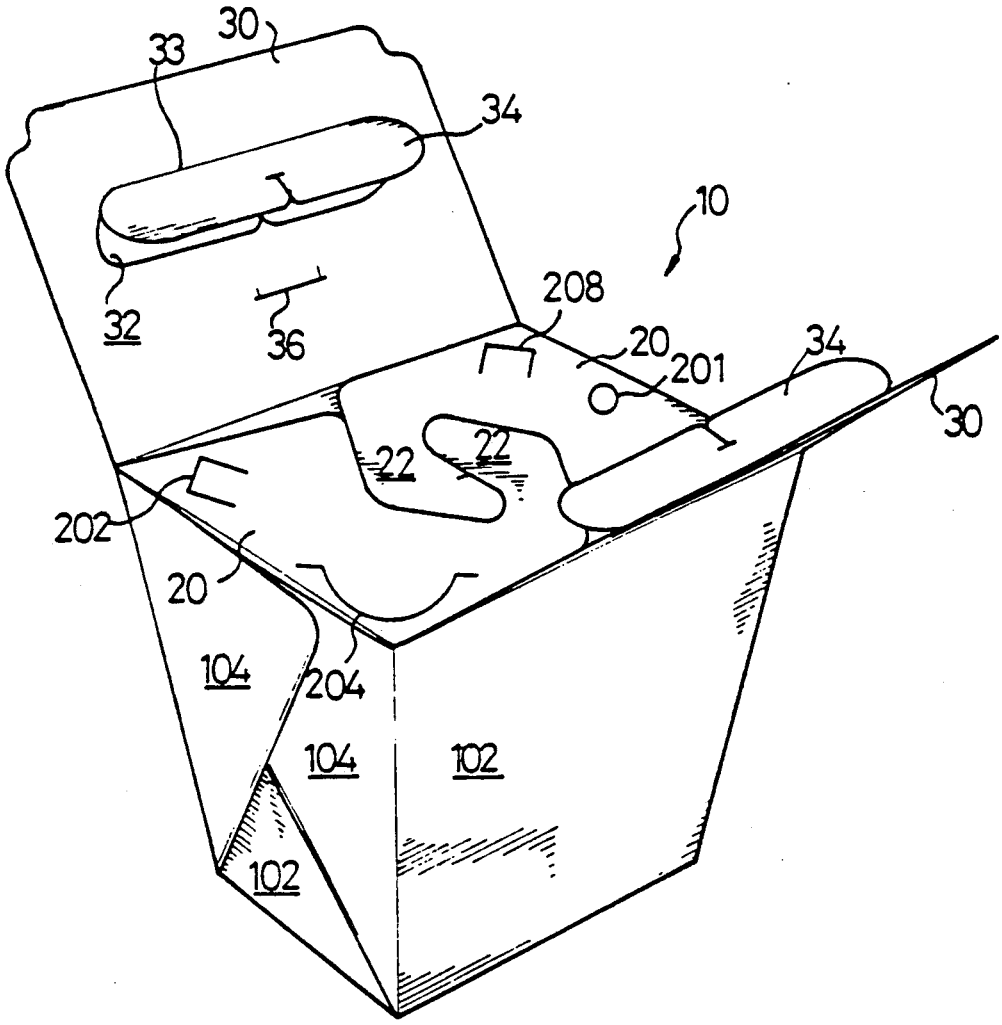
FIG. 4 is a perspective view of a container according to the present invention, showing that the inner flaps are interconnected with each other.

Referring now to FIGS. 3 and 4, there is shown an unfolded multifid pressboard 10' and a folded container 10, respectively, in accordance with the present invention. The pressboard 10' is a single piece and comprises a central multisectioned portion, which is consisted of a central bottom wall 106 and four side walls 102 alternately spaced by folding walls 104, and a pair of inner flaps 20 and a pair of outer flaps 30 extending from corresponding peripheral edges of the central portion. It is noted that the pressboard 10' and its partitions, as well as the formations of the inner and outer flaps, are well known in this art, and do not constitute parts of this embodiment of the invention. What the present embodiment of the invention is directed to is the particular shape and configuration of the inner and outer flaps 20 and 30, which will be described in detail hereinbelow.

FIG. 4 shows the container 10, constructed from the pressboard 10' shown in FIG. 3, in a configuration where the pair of inner flaps 20 are interconnected with each other by an engaging means formed thereon and the pair of outer flaps 30 are open for increased clarity. Instead of securing adjacent folding walls 104 by the wire handle 180 of FIGS. 1 and 2 to retain the configuration of the container body 120 of the prior art container 100 of FIG. 1, adjacent folding walls 104 of the container 10 of the present invention may be secured together by a simple operation, such as gluing or the like.

Figure 15:
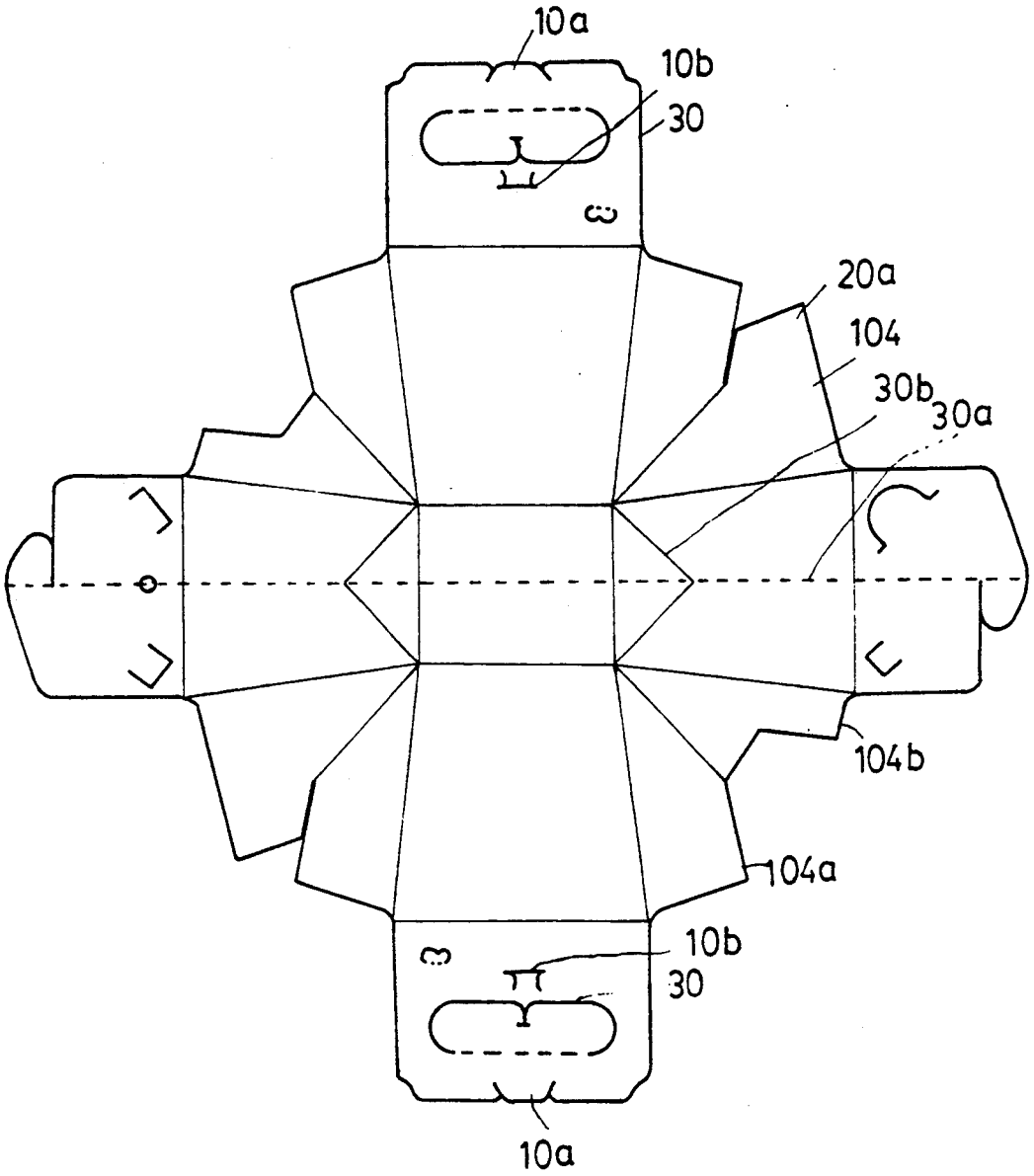
FIG. 15 shows the unfolded top plan view of the pressboard for constructing the container of FIG. 3 with additional improvements.
Figure 16:
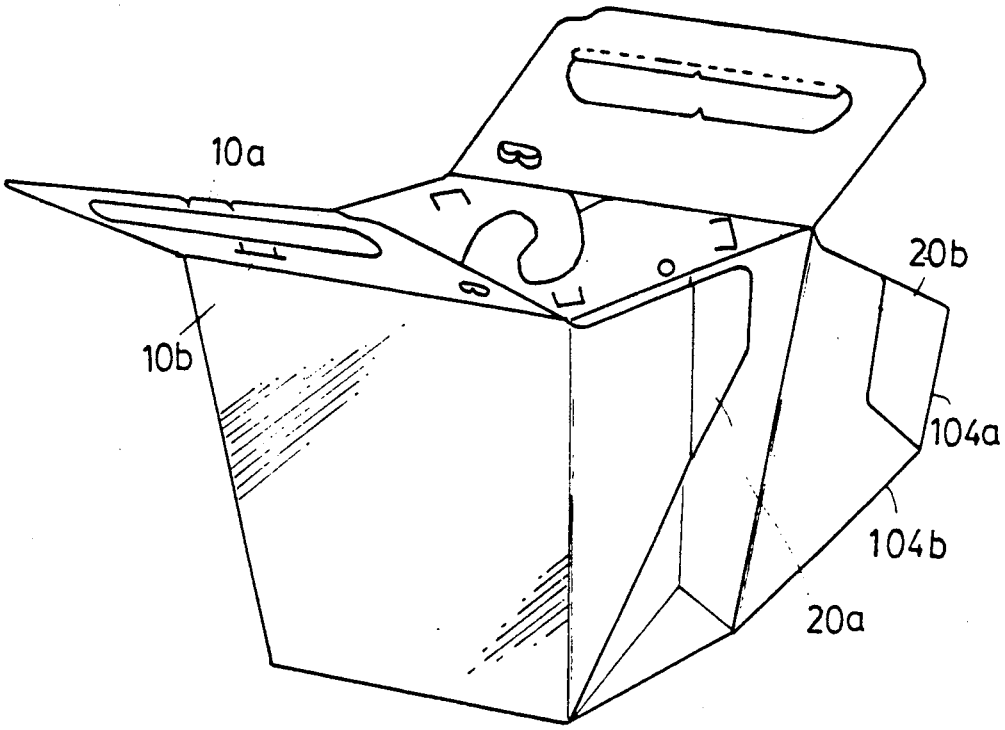
FIG. 16 is a perspective view of the container according to the present invention ready to function with the improvements of FIG. 15.

FIGS. 15 and 16 show alternative structure integrally formed on the container for securing folding walls 104 to each other. As shown in FIGS. 15 and 16, folding walls 104 have a tab **20*a* formed on each of two diagonally opposite walls 104. Tab 20*a* is formed to be slipped into a pocket 20*b* formed on the two remaining diagonally opposite walls 104. Pocket 20*b* is formed on these walls 104 between the folded segments of wall 104*a* and wall 104*b* when the pressboard of FIG. 15 is folded to make the container operative. Elements 20*a* and 20*b*** eliminates the need to secure the folded walls together by other means such as glueing or stapling.

In both the embodiments of FIG. 3 and FIG. 15, it is clear that the engaging means comprises a respective finger portion 22 on one side of the inner flap 20, formed by a slit 23 cut on the pressboard 10' during manufacturing. The inner flaps 20 may further comprise slits of various shape. In FIGS. 3 and 15, one inner flap 20 is shown to have a U-shaped slit 202 and a semi-circular slit 204 on respective corners thereof. The other inner flap 20 also has a U-shaped slit 206 and an elongate U-shaped slit 208 on respective corner thereof, and a substantially circular slit or a through hole 201. As can be seen in FIG. 4 and will be apparent later, the semi-circular slit 204 and the elongate U-shaped slit 208 provided on a diagonal or far corner with respect to the slit 204 are designed to cooperate with each other. The same situation applies to the U-shaped slit 202 and the U-shaped slit 206 as well.

The pair of outer flaps 30 have a hand-accessible means integrally provided thereon formed by a respective finger slots 32 by means of a punch-out flaps 34 complementary in shape to the slots 32 and integral to the outer flaps 30. As will be apparent later, the punch-out flaps 34 are so configured that they are both bendable inwardly and upwardly about a junction line 33 and are mutually engageable with each other, thereby forming a stacked-flap structure for supporting chopsticks thereon and permitting user's fingers to carry the container from below the stacked-flap structure (cf. FIG. 10). The outer flaps 30 also have slits or flaps thereon so as to be anchorable to each other as shown in FIGS. 3 and 15. In FIG. 3, one of the outer flaps 30 is shown to have a substantially U-shaped slit 36 and the other flap 30 is shown to have an engaging flap 38 formed by a pair of parallelly spaced slits cut through to a peripheral edge thereof.

In FIG. 15 both outer flaps 30 have a truncated shaped tab 10*a* selectively engageable to a corresponding slit 10*b* located on opposite outer flaps 30. As can be seen the form of tab 10*a* and u-shaped slit 10*b* with arced sides provide for better engagement to each other in comparison to flap 38 and slit 36 due to increased frictionally engagement as tab 10*a* is inserted into slit 10*b*. Further, provision for tab 10*a* and slit 10*b* on both flaps 30 make flaps 30 interchangeable when used to close and stack the container and eliminate any need by the user to determine which flap 30 needs to be folded first as in the embodiment using flap 38 and slit 36.

Figure 5:
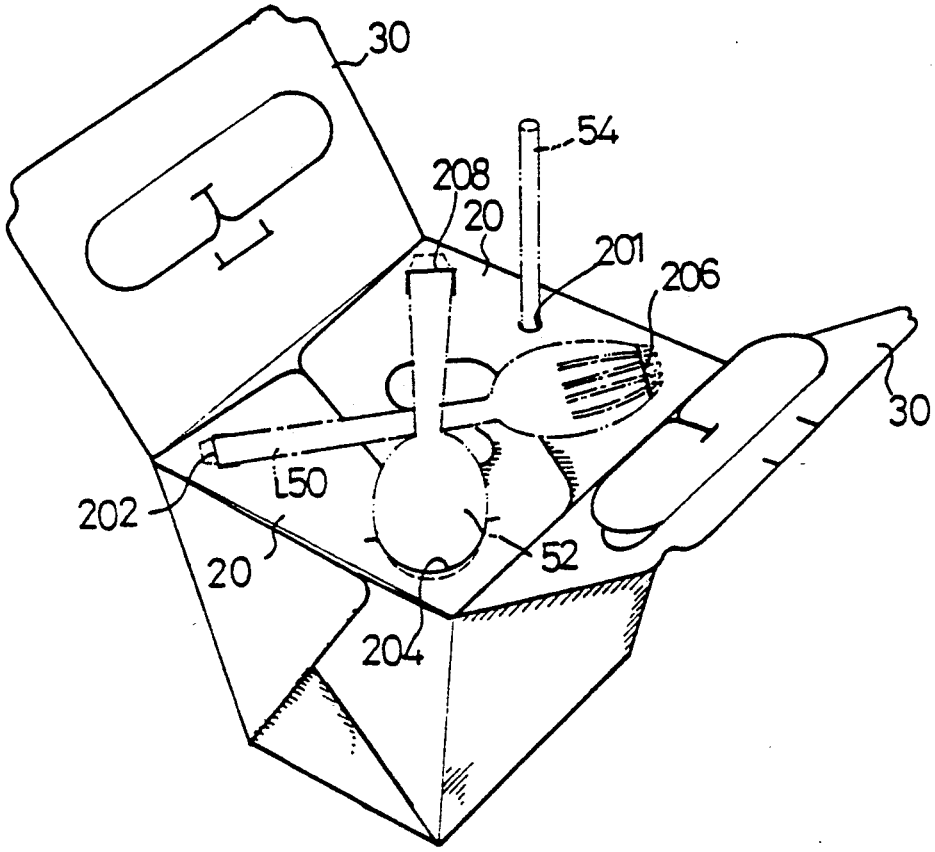
FIG. 5 is a view similar to FIG. 4, showing that the inner flaps receive a fork, a spoon, and a straw thereabove.
Figure 6:
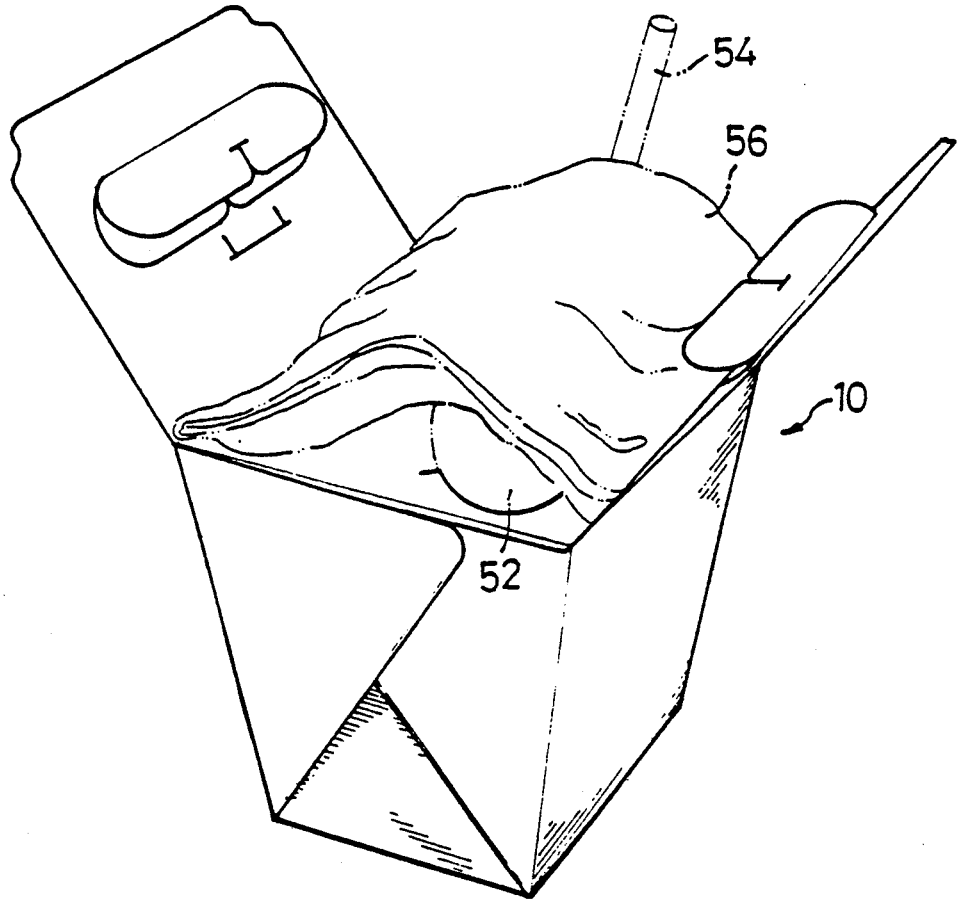
FIG. 6 is a view similar to FIG. 5, showing that the inner flaps further receive a napkin.

FIG. 5 shows the slits provided on the inner flaps 20 can be used to receive or support a fork 50, a spoon 52, and a straw 54 (all shown in phantom line) of suitable size on an upper surface thereof. As desired, napkins 56 can be further provided above the mentioned implements, as shown in FIG. 6. It is noted that the provision of the fork, spoon, straw, napkins or the like on the pair of inner flaps 20 does not interfere with the normal function of the pair of outer flaps 30, as will be apparent later. This feature can not be found in the prior art container 100 shown in FIG. 1.

Figure 7A:
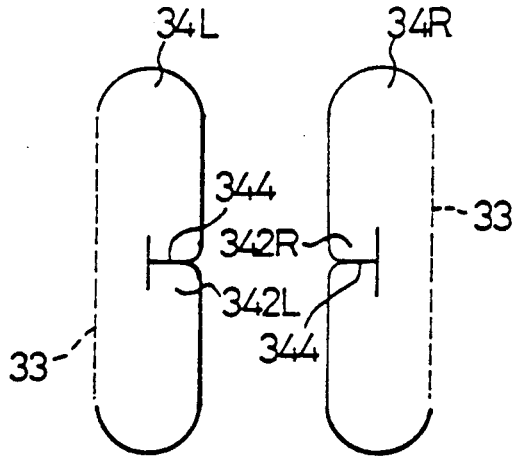
FIG. 7A is a plan view of a portion of the outer flaps of the invention, showing a respective punch-out flap according to one embodiment of the invention.
Figure 7B:
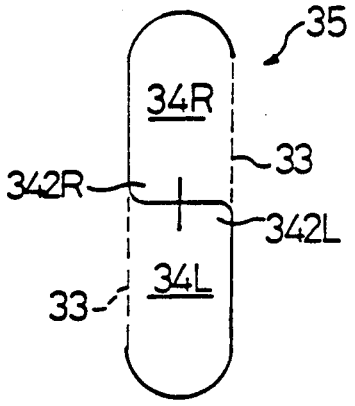
FIG. 7B shows the punch-out flaps of FIG. 7A engaged with each other.
Figure 8A:
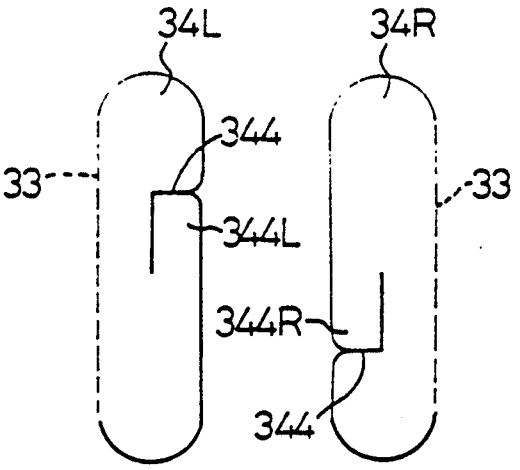
FIG. 8A is a view similar to FIG. 7A, showing a respective punch-out flap according to another embodiment of the invention.
Figure 8B:
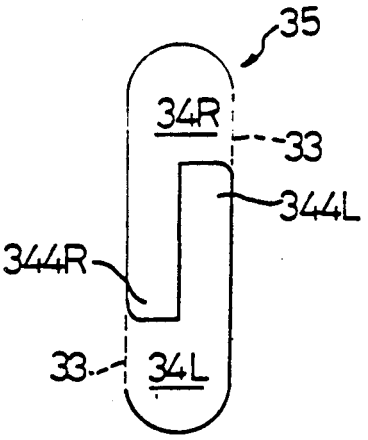
FIG. 8B shows the punch-out flaps of FIG. 8A engaged with each other.

As mentioned above, the punch-out flaps 34 on the outer flaps 30 are so configured that they are engageable with each other to form a stacked-flap structure for supporting chopsticks thereon and permitting user's fingers to carry the container of the invention from below the stacked-flap structure. FIGS. 7A, 7B, 8A and 8B show how the punch-out flaps 34L and 34R ("L" and "R" indicate left and right, respectively) are engageable with each other to form a stacked flap 35. In FIGS. 7A and 7B, the punch-out flaps 34L and 34R each have a slit 344 on approximately a middle thereof. The slit 344 is disposed at an opposite side with respect to the junction line 33 and extends perpendicular to the junction line 33, so that the two slits 344 align with each other. In FIG. 7B, the punch-out flaps 34L and 34R are engaged with each other to overlappingly form the stacked flap 35, in which the portion 342L proximate to the slit 344 on the flap 34L is situated above the flap 34R, and the portion 342R proximate to the slit 344 on the flap 34R is situated above the flap 34L. FIG. 8A shows a variation of the slit 344, in which unlike the slits 344 disposed at approximately a middle of the flaps in FIG. 7A, the slits 344 now are displaced from the middle so that they no longer align with each other. In this case, in order to engage the flaps with each other, a user has to align the flaps by displacing each flap in opposite directions. After engagement, as shown in FIG. 8B, the stacked flap 35 obtained is nearly identical to that of FIG. 7B in appearance. To disengage the stacked flap 35 of FIG. 7B, the flaps 34L and 34R are simply pulled from each other. To disengage the stacked flap 35 of FIG. 8B, a reverse operation for the engagement will have to be performed. From this it is clear that the engagement for the stacked flap 35 of FIG. 8B is more stable than that of FIG. 7B.

Figure 9:
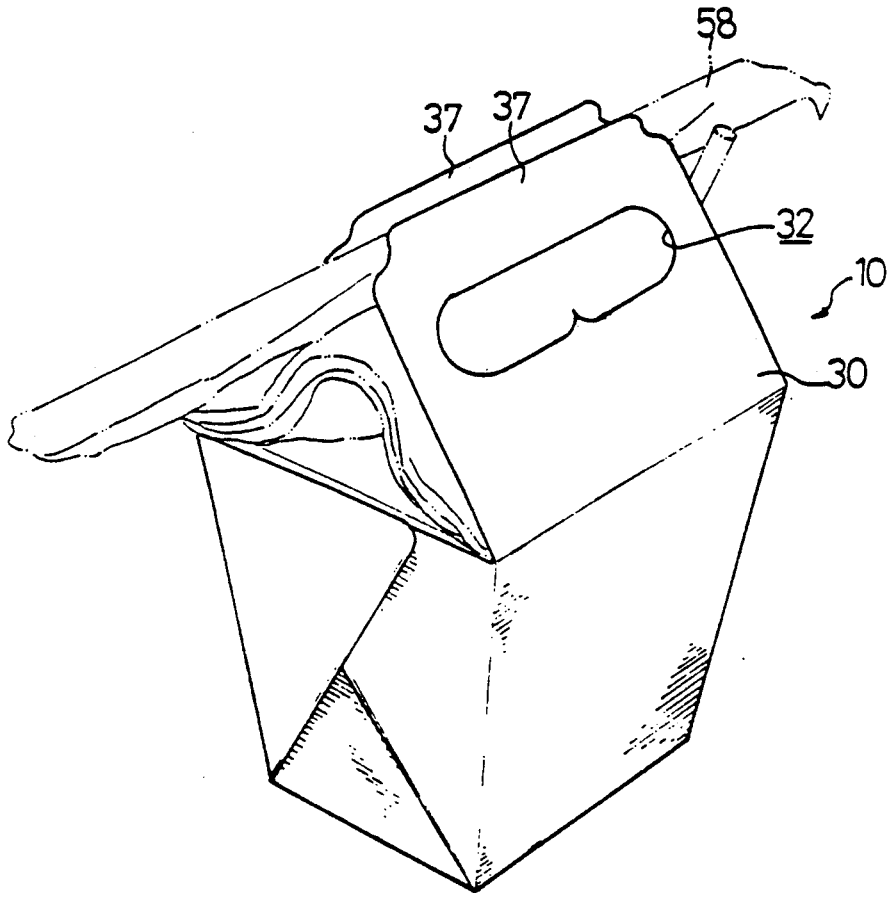
FIG. 9 is a perspective view of a container according to the present invention, showing that the outer flaps are engaged with each other to further receive a package of chopsticks.
Figure 10:
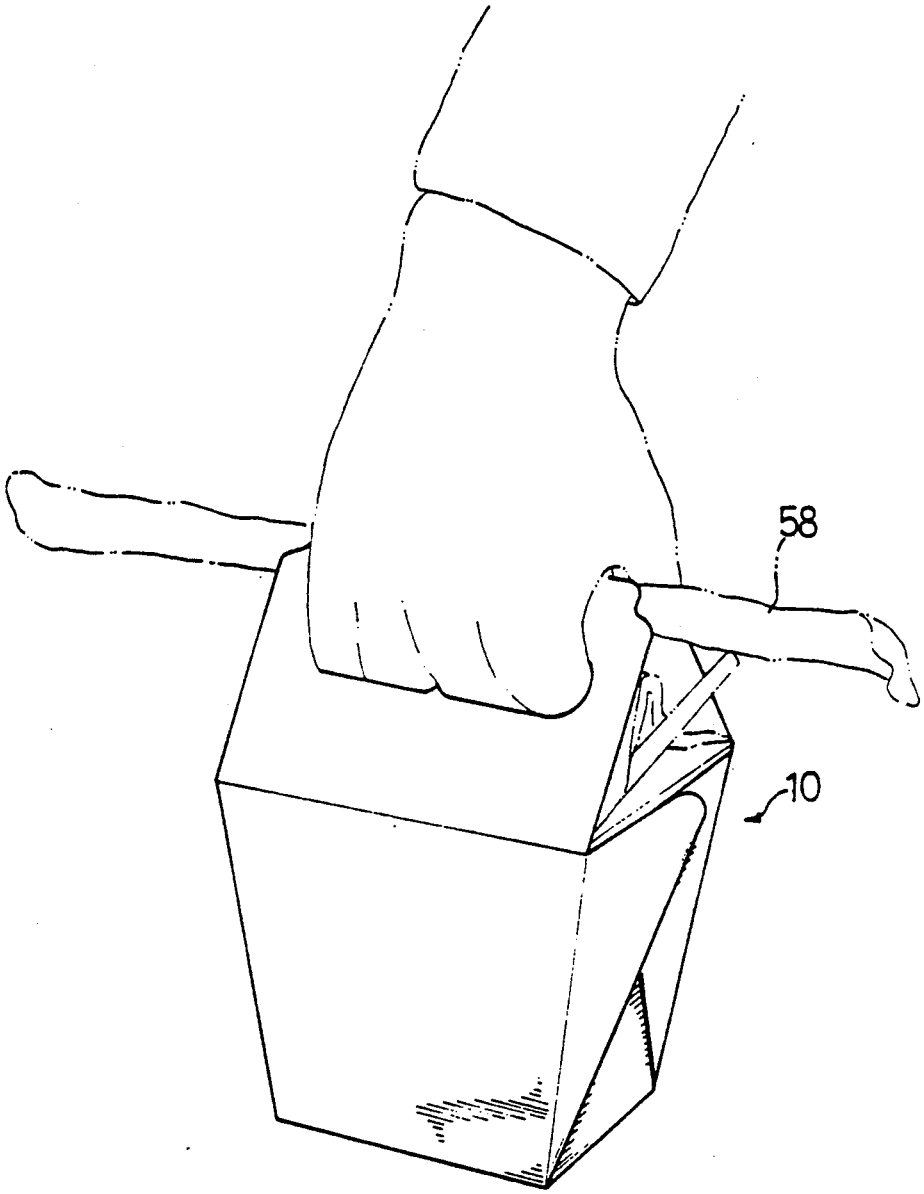
FIG. 10 shows that the outer flaps of the container in FIG. 9 may be clasped by a user's fingers.

FIGS. 9 and 10 show that both the stacked flaps 35 in FIGS. 7B and 8B can be used to receive and support a package of chopsticks 58 within a triangular area or space which is defined by respective end portion 37 on the outer flaps 30 and the stacked flap 35. FIG. 10 further shows that the hand-accessible means formed by the finger slots 32 and the punch-out flaps 34 allows a user's fingers to pass through the finger slots 32 and clasp around the end portions 37 and a bottom of the stacked flap 35. It is noted that the triangular space is particularly suitable for clasping by a user's fingers.

Figure 11:
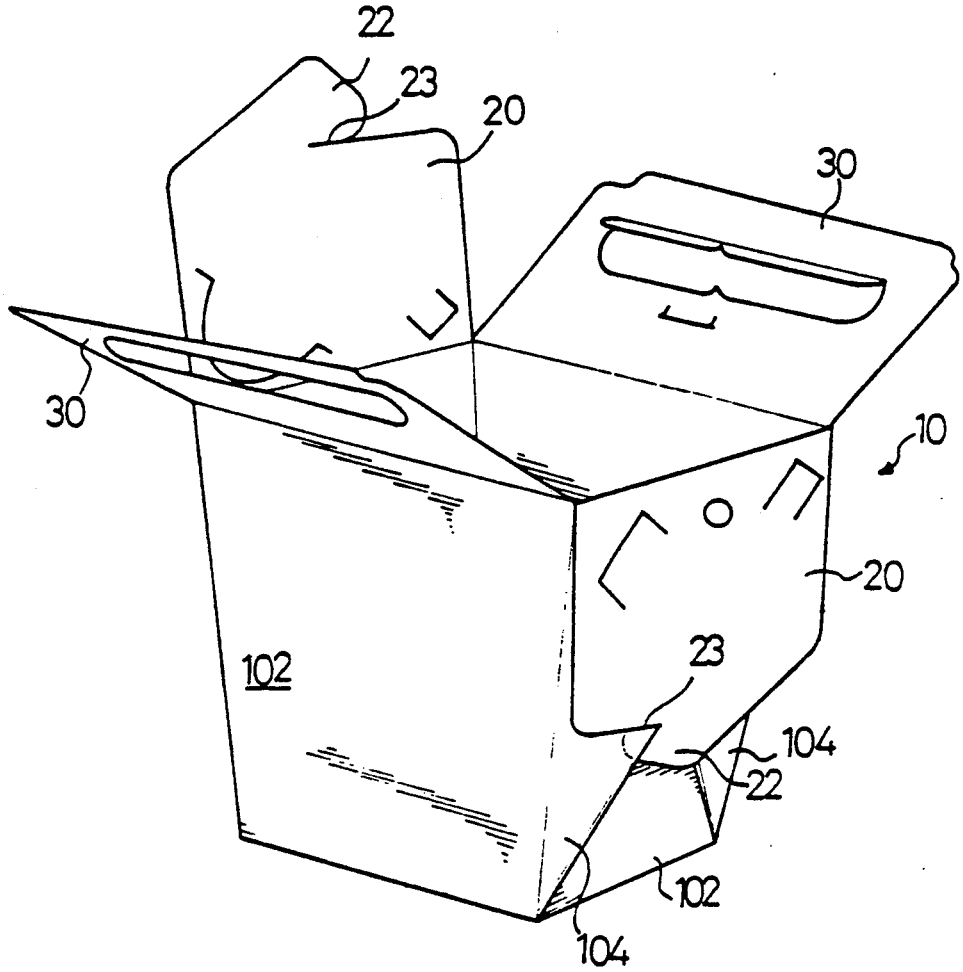
FIG. 11 is a perspective view of the container of the invention showing one of the inner flaps being anchored to a side wall of the container body.
Figure 12:
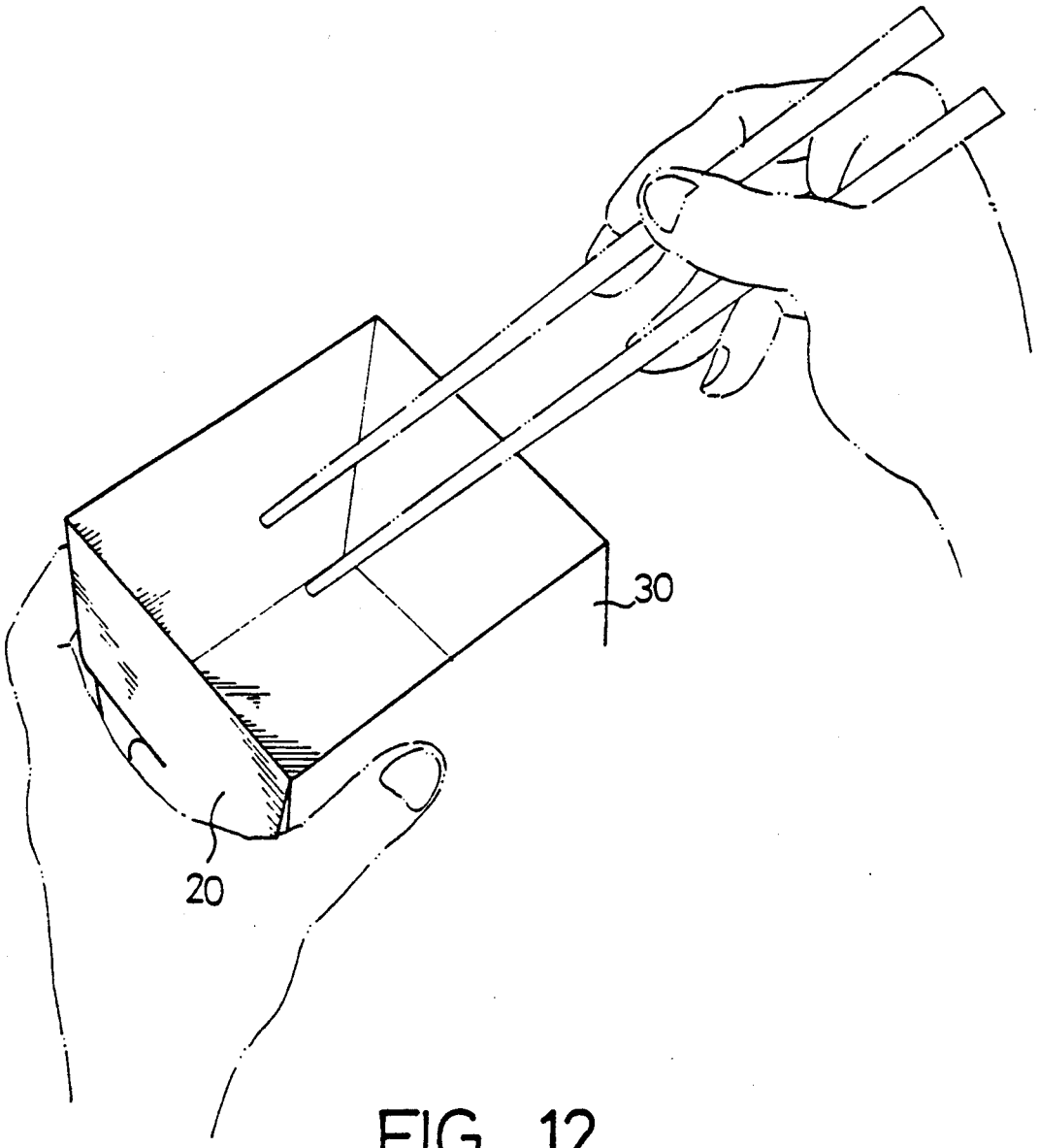
FIG. 12 is a perspective view of the container of the invention, showing that the inner flaps are anchored to side walls of the container body and the outer flaps are manually held against the container body for easy access of the contents of the container.

FIG. 11 shows how the engaging means, consisting of the finger portions 22 and the slits 23 on the inner flaps 20, can further be used to anchor the flaps 20 to the container body. That is, the finger portions 22 can be inserted into recesses formed between one of the side walls 102 and one of the corresponding folding walls 104. FIG. 12 further shows that, while food is within the container body, the pair of inner flaps 20 can be anchored to the container body and, at the same time, both the outer flaps 30 can be pressed against the container body, by a user's fingers, so that access to the food is convenient.

Figure 13:
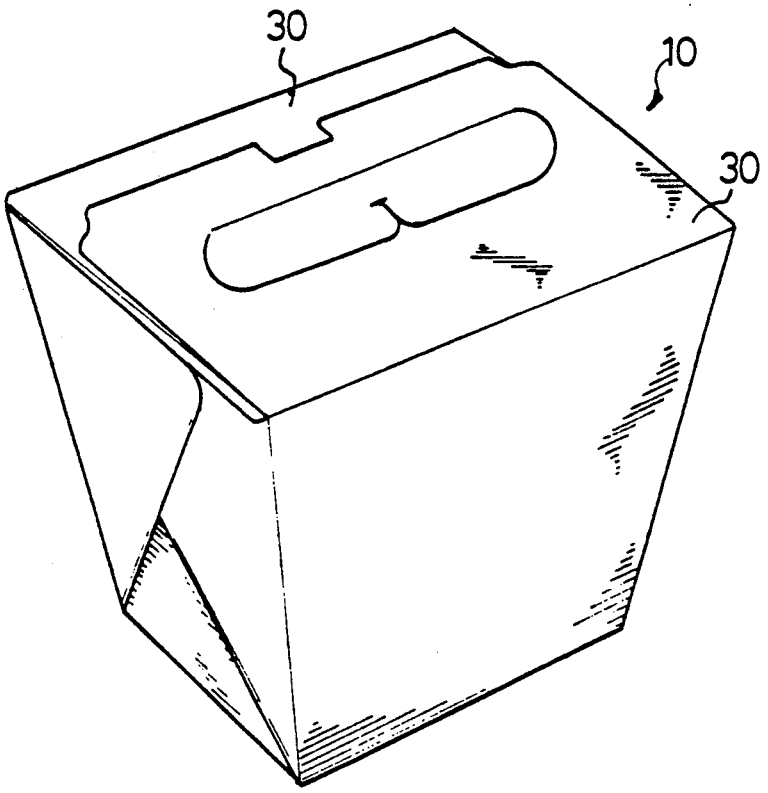
FIG. 13 is a perspective view of the container of the invention, showing that the outer flaps are interconnected with each other to close the opening of the container.

As is apparent from the above description and FIG. 13, the substantially U-shaped slit 36 on one of the outer flaps 30 can be engaged with the engaging flap 38 on the other outer flap 30 so that the outer flaps 30 are interconnectable with each other, thereby closing the opening of the container body. This allows stacking and easy storage of the containers of the invention. As discussed previously, tab 10*a* and 10*b* shown in FIG. 15 serve the same purpose but provide the ability to make flaps 30 interchangeable.

FIG. 15 shows fold lines 30*a* and 30*b* which provide an ability to collapse the container of the present invention.

Figure 17:
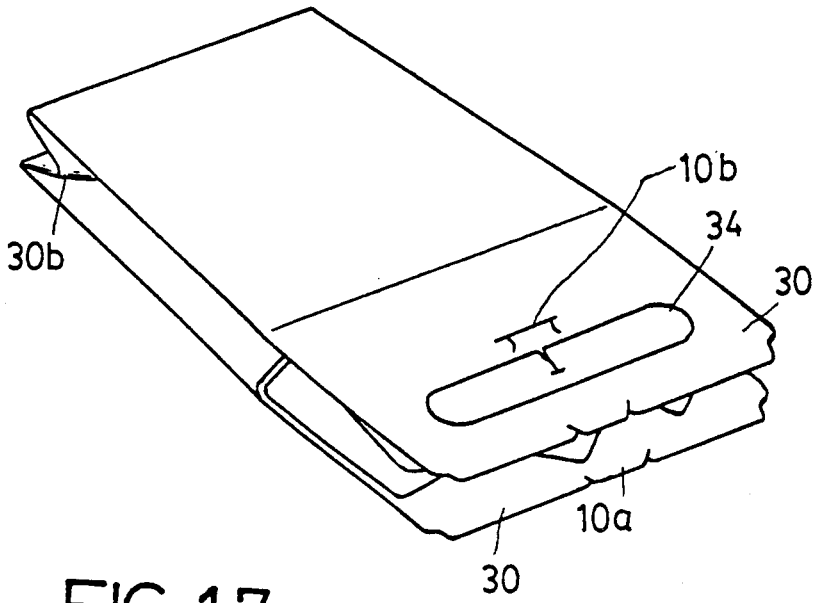
FIG. 17 is a perspective view of the container according to the present invention with the improvements of FIG. 15 partially collapsed along fold lines.

FIGS. 17 show the the container partially collapsed along fold lines 30*a* and 30*b* and demonstrates how these novel features permit for ease of shipping the collapsed container and the collapsed container's ability to be readily expanded and used after shipping.

Figure 18:
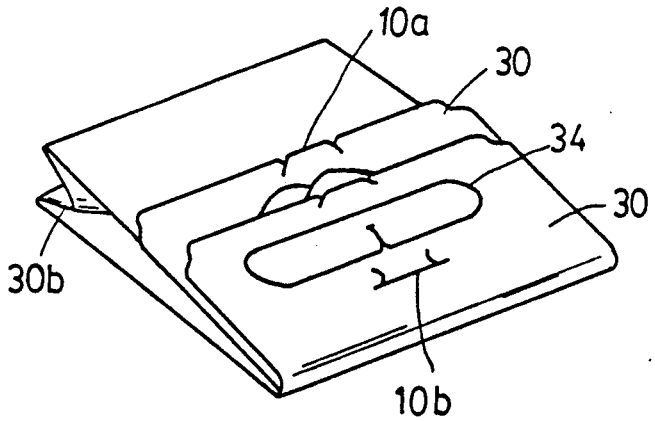
FIG. 18 is a perspective view of a container according to the present invention fully collapsed along fold lines showing the improvements of FIG. 15.

FIG. 18 shows the container collapsed to the greatest extent possible along provided fold lines for even more compact shipping without affecting its ability to be readily expanded and used after shipping.

Figure 14:
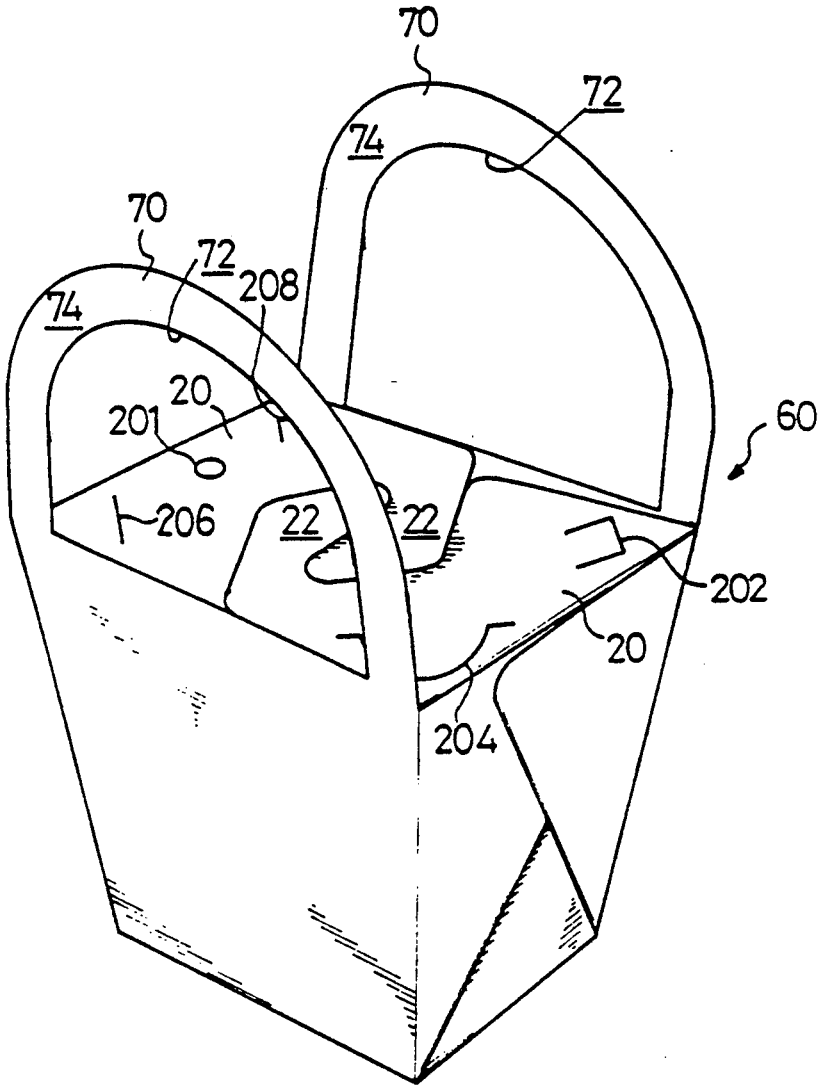
FIG. 14 is a perspective view of a container with modified outer flaps in accordance with the present invention.

FIG. 14 shows another embodiment of the container in accordance with the present invention. In this embodiment, the inner flaps 20 are essentially the same as that shown in FIG. 4, while the outer flaps 70, which permit a clasping operation by a user's hands, are substantially semi-circular shaped. The outer flaps 70 comprise a respective semi-circular hole 72 thereon, forming a respective ring strip 74 which is claspable by a user's hand.

While the present invention has been explained in relation to its preferred embodiment, it is to be understood that various modifications thereof will be apparent to those skilled in the art upon reading this specification. For example, the container may be made of a very thin plastic sheet instead of a pressboard. Therefore, it is to be understood that the invention disclosed herein is intended to cover all such modifications as shall fall within the scope of the appended claims.

I claim:

1. A container for accomodating foods having a body with four side walls, connected by folding walls and a bottom side, said container comprising:

a pair of first flaps integrally extending from a pair of opposite peripheral edges of the body, each said first flap having an engaging means thereon for interconnecting with each other, said engaging means being engageable with a pair of side walls of the body so that first flaps are anchorable to the body, thereby providing easy access to the contents of the body;

a pair of second flaps integrally extending from another pair of opposite peripheral edges of the body, each said second flap having a hand-accessible means thereon for permitting a clasping operation by user's fingers;

wherein said engaging means comprises a respective finger portion integrally formed on each first flap, substantially pointing in opposite directions, so that said finger portions are clippable to substantially close an opening of the container body;

said hand-accessible means on said second flap including a respective finger slot on each said second flap having a punch-out flap integral to said second flap, said punch-out flaps being bendable inwardly and upwardly and being mutually engageable with each other, thereby forming a stacked flap for supporting chopsticks thereon and permitted user's fingers to carry the container from therebelow;

the improvement which comprises:

one said first flap having two first slits formed in two opposite corners of one said first flap, and the other said first flap having two second slits formed in two opposite corners of the other said first flap, said two first slits and said two second slits being diagonally opposite each other for respectively receiving a spoon and a fork in all said first and second slits on said two first flaps when folding said container; and each said punch-out flap of each said second flap including two parts and a slit for separating said two parts, two said slits of two said punch-out flaps being aligned with each other so that two said punch-out flaps are cross-linkable to thereby substantially anchor two said second flaps each other.

* * * * *